United States Patent [19]

Egerstrom

[11] 4,066,093

[45] Jan. 3, 1978

[54] HOSE FEEDING WINCH

[75] Inventor: Bengt Gunnar Wilhelm Egerström, Danderyd, Sweden

[73] Assignee: Nitro Nobel AB, Gyttorp, Sweden

[21] Appl. No.: 726,173

[22] Filed: Sept. 24, 1976

[30] Foreign Application Priority Data

Oct. 1, 1975 Sweden ..... 7511025

[51] Int. Cl.[2] ..... B65H 75/34

[52] U.S. Cl. ..... 137/355.2; 137/355.12; 137/615; 242/54 R; 242/86.2; 242/117

[58] Field of Search ..... 137/355.12, 355.16–355.27, 137/615; 239/165, 195, 198, 199; 242/54 R, 86, 86.2, 86.5 R, 117

[56] References Cited

U.S. PATENT DOCUMENTS

| | | | |
|---|---|---|---|
| 2,708,080 | 5/1955 | Lebus | 242/117 |
| 3,175,574 | 3/1965 | Morford | 137/355.26 |
| 3,291,256 | 12/1966 | Eitel | 242/86.5 R |
| 3,744,719 | 7/1973 | Wallick | 239/199 |

*Primary Examiner*—Robert G. Nilson
*Attorney, Agent, or Firm*—Shlesinger, Fitzsimmons & Shlesinger

[57] ABSTRACT

The invention relates to a hose feeding winch intended for use in charging drill-holes with pulverulent or pumpable explosives through a hose inserted into each individual drill-hole. The winch comprises a drum rotatable about a central shaft, a drum cage enclosing said drum and rotatable about said central shaft, and a cradle supporting the central shaft and rotatable about a central axis on the platform of the truck. The drum has means forming a channel or path for the charging hose to be wound and unwound thereon in a single layer, and without displacement by sliding movement in radial or peripheral direction on the surface of the drum. The cradle carries an extensible unit adapted to be elevated relative to the cradle, and comprising two parts longitudinally slidable the one within the other, and a nose device swingably attached to the discharge end of the extension unit, and equipped with means for guiding the hose from the drum and along the extension unit, and means for aligning the front end of the hose with the axis of the drill-hole to be charged with explosive. The truck carries explosives that are fed to the charging hose. By rotation of the drum the hose is fed through the extension unit and into the drill-hole. Two power control pulpits are arranged on the truck to be accessible to an operator standing behind the truck.

17 Claims, 7 Drawing Figures

HOSE FEEDING WINCH

The present invention relates to a hose feeding winch especially intended in connection with charging of drill-holes to take up and advance a charging hose for powder explosives or pumpable explosives.

In the charging of drill-holes, in particular in rock chambers with narrow spaces, where the charging is to be effected in both walls and roofs, it is of considerable value to automate the charging work to the greatest possible extent and to bring about quick charging of many drill-holes. For this purpose a plurality of different moments of operation are required. Thus, when utilizing a charging hose there are required according to known technique separate support and feeding devices for the hose and, furthermore, specific devices for alignment of the hose relative the drill-holes.

The object of the invention is to provide a hose feeding winch which in itself, as is evident also from the denomination, functions both as winding-up device, i.e. storage device, and feeding device. The arrangement shall be of such a kind that a tube positioned on the winch shall be easily adjustable finely with respect to a selected charging hole in order thereafter to be fed directly into the same and thereupon while the charging is in progress to be retreated at the same rate as the hole is being filled with explosive.

A winch of the type mentioned in the introductory paragraph which complies with the demands set forth above is according to the invention primarily distinguished thereby that it includes a rotatable drum coupled together with a central shaft and having members for guiding the hose when being unwound or wound up in a single layer on the jacket surface of the drum, a drum cage mounted for separate rotation on the central shaft with cage elements disposed around the drum with interspaces adapted to the cable on the jacket thereof in order to limit movement of the hose in the radial direction of the drum, and a cradle which supports the central shaft.

The invention is described nearer below in the form of a preferred embodiment with reference to the attached drawings, similar details and units illustrated in the various drawing figures being provided with the same reference denominations.

Figure 1:
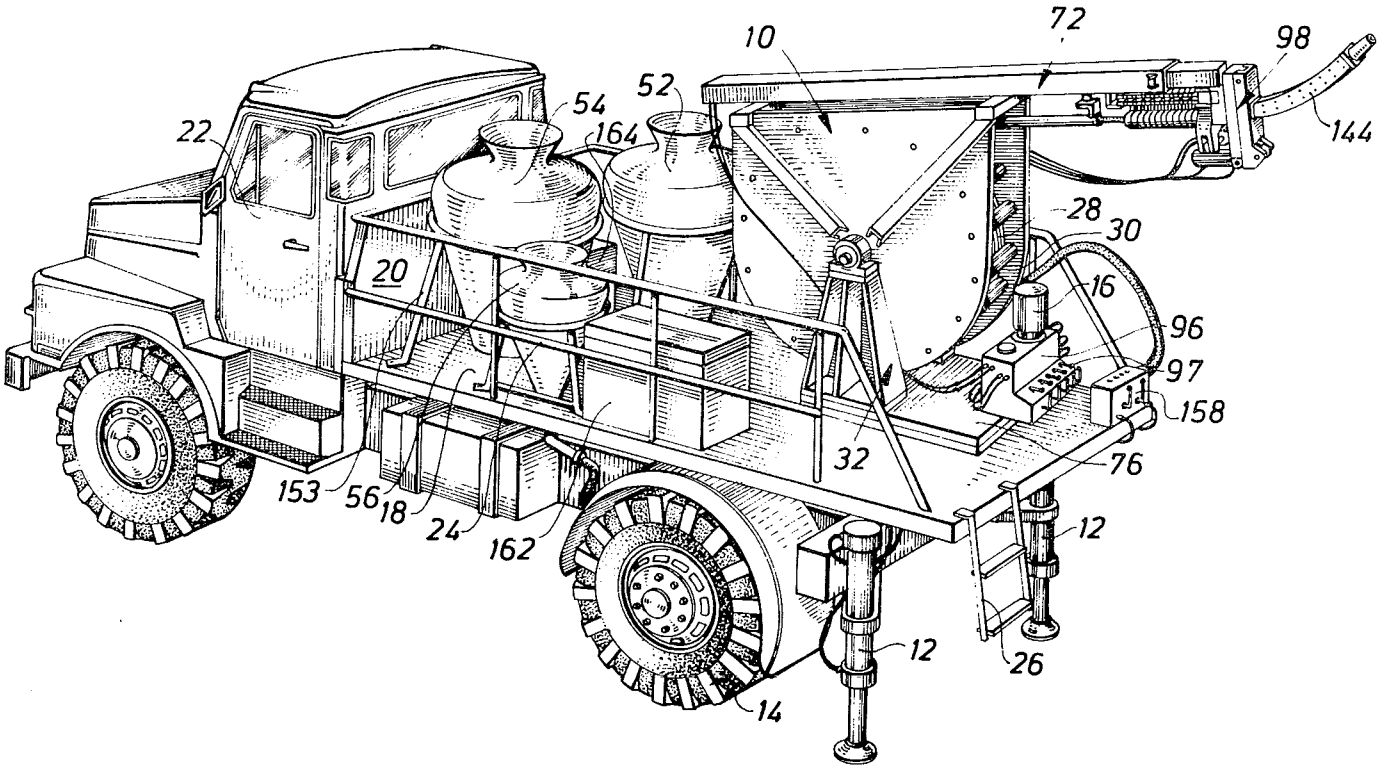
FIG. 1 shows a perspective view of a truck, the platform of which has been equipped with the novel hose feeding winch together with associated means for operation of the winch and for advance feed of various explosives.

The hose feeding winch 10 constructed according to the invention and additional equipment which is used in the charging of drill-holes, are disposed in the preferred embodiment illustrated in FIG. 1 on a truck chassis which is equipped with telescopically operated support legs 12 located behind the rear wheels 14 and in conventional manner operated by the own hydraulic system of the vehicle. The whole truck platform is coated with a strong aluminum floor plate 18, and a separate protective wall 20 faces the driver's cab 22. Furthermore, a protective railing 24 is disposed along the longitudinal sides of the platform, and at the rear edge of the platform a step-ladder 26 is to be found for boarding the platform. The step ladder 26 can be raised so that the truck can be moved backwards into bulk masses without the step-ladder 26 constituting an obstacle.

The novel hose feeding winch 10 arranged on the truck platform and devised according to the invention comprises substantially three main parts, namely a hose drum 28 intended for hose storage, a drum cage 30 encasing the drum and a unit in the design of a cradle 32 supporting the drum 28 and the drum cage 30.

Figures 2, 3, 4:
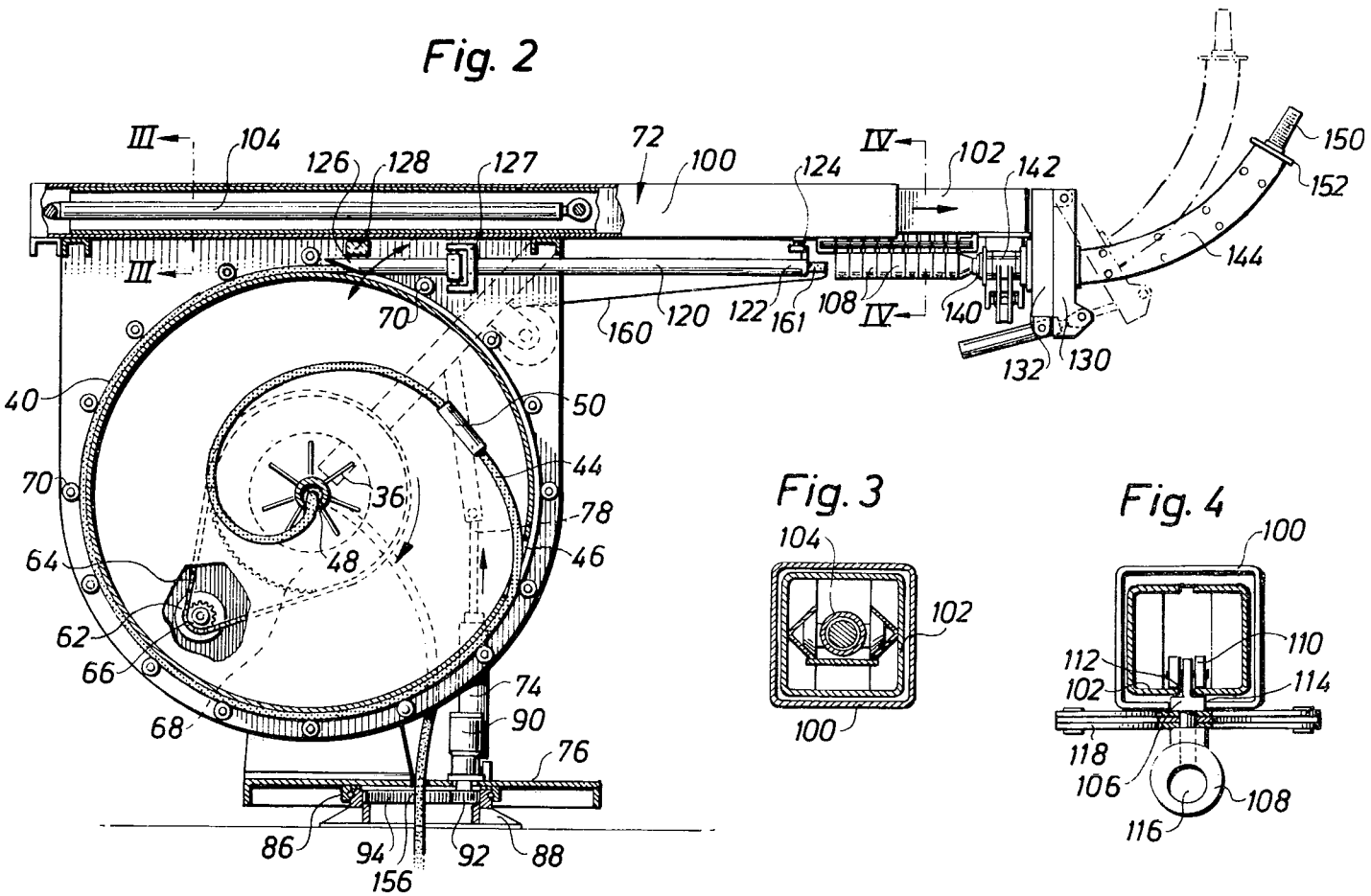
FIG. 2 shows, partly in section, a vertical side-view of the novel hose feeding winch.
FIGS. 3 and 4 show sections taken along the lines III—III and IV—IV, respectively of FIG. 2 illustrating an example of a telescopic design known per se.
Figure 5:
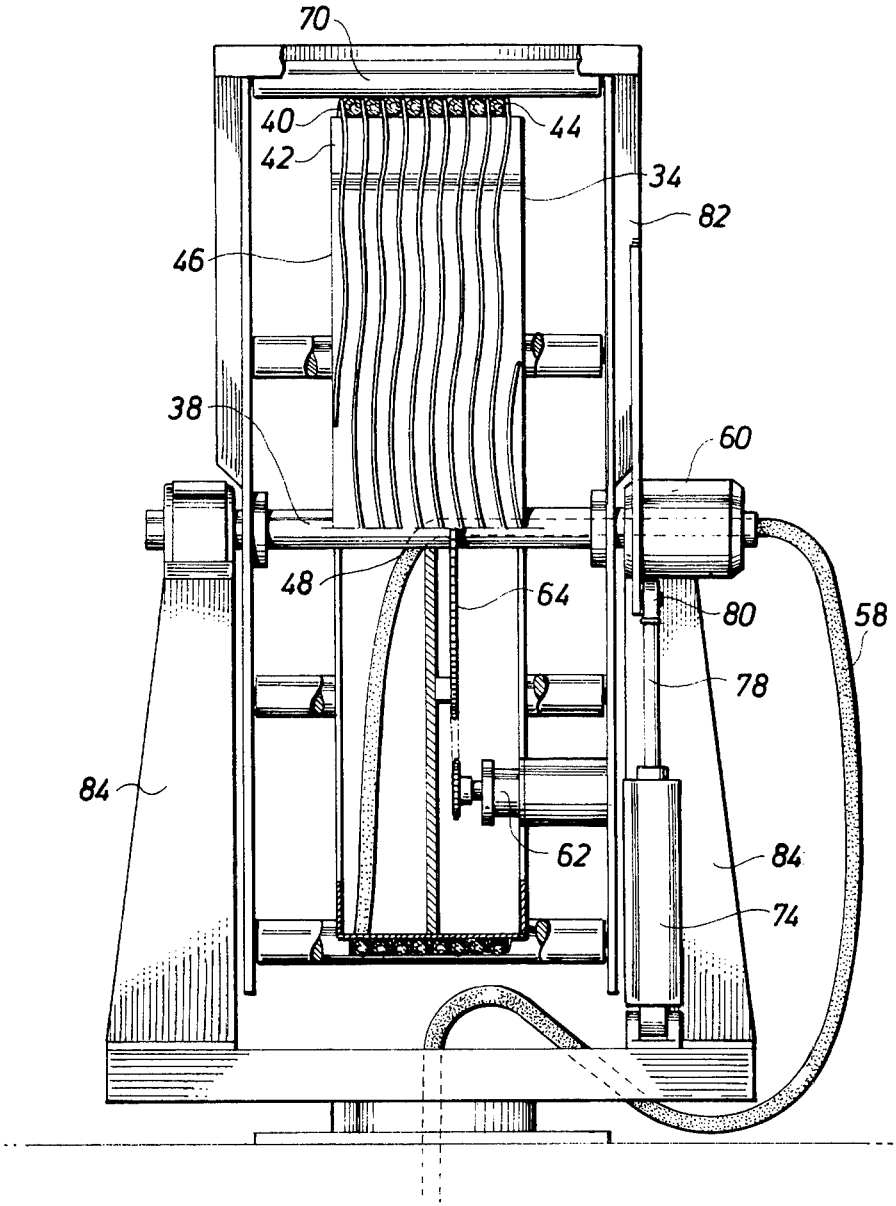
FIG. 5 shows an end view, partly in section, of some details forming part of the novel hose feeding winch and parts coupled to the winch.
Figure 6:
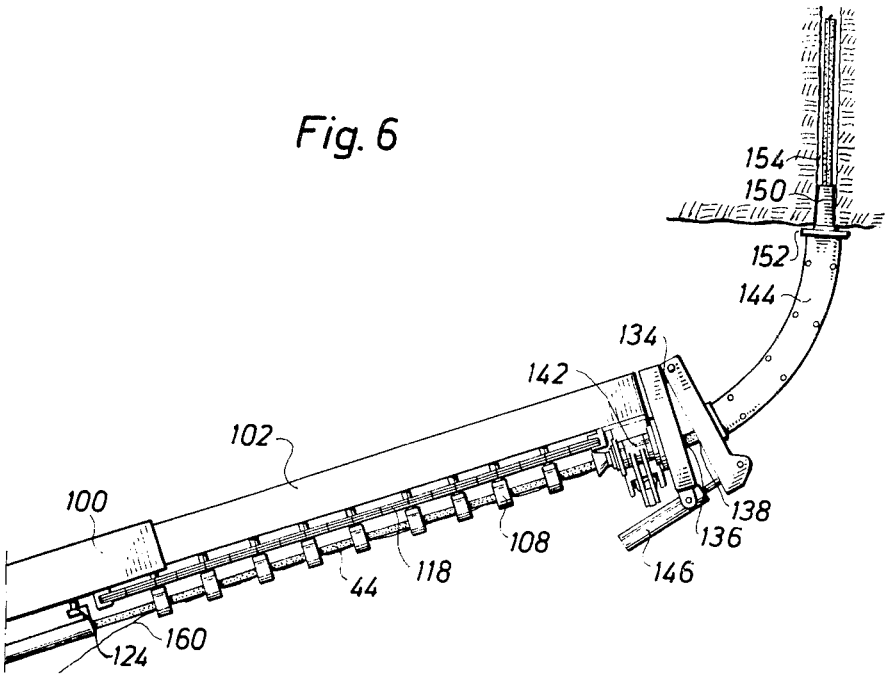
FIG. 6 shows a perspective view of front portions belonging to the hose feeding winch and intended for alignment of the charging hose.
Figure 7:
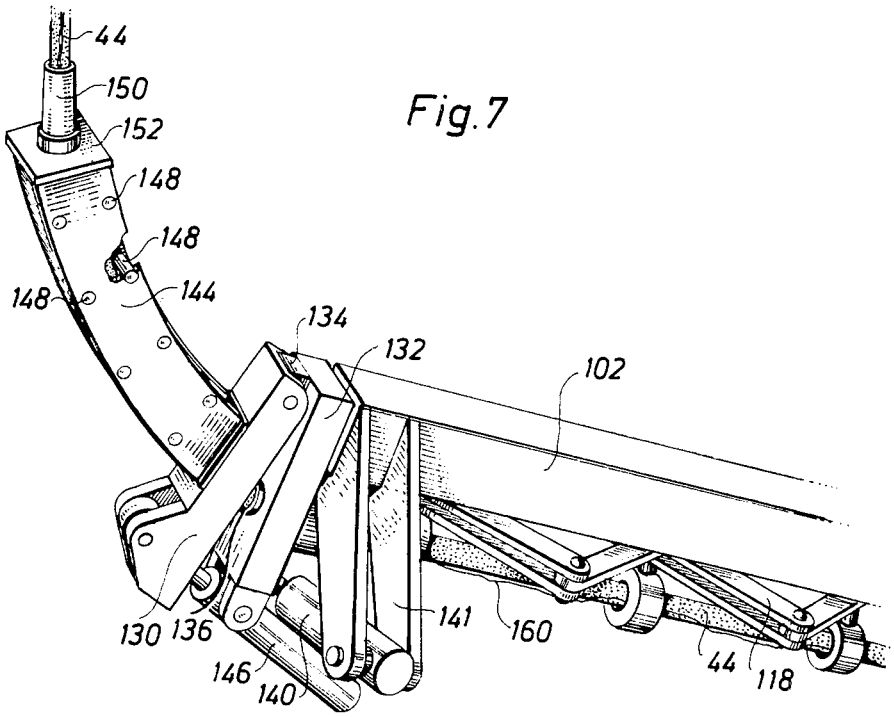
FIG. 7 shows in a side view the portions illustrated in FIG. 6, the hose being fed into a drill-hole.

The drum 28 is equipped with a central wall 34 (FIG. 5) and contains a central shaft 38 provided with radial, transversely extending stiffening flanges 36 (FIG. 2), and which shaft consists of a tube mounted rigidly relatively to the peripheral jacket 42 of the drum 28. By means of a spirally wound sheet iron 40 placed on edge, the jacket surface 42 is equipped with a grooved, spirally rising track for storing the hose in one single layer. The breadth of the drum is adapted to the desired length of the charging hose. It is of utmost importance for the charging operation that a wound-up charging hose 44 cannot creep in peripheral direction in the hose track and to this end the spiral track has a slightly winding running. This is clearly evident from FIG. 5. At the end of the spiral track for the charging hose 44, i.e. adjacent the one end 46 of the drum 28, there is mounted a separate device (not shown in the drawing) for fastening the charging hose 44. At that place on the drum 28 the charging hose 44 is guided through an opening 46 in the jacket 42 of the drum 28, whereafter it extends in a curve to a recess 48 in the central shaft 38. Provided between the opening 46 and said recess 48 is a jointing means 50 which renders possible when required to unfasten and exchange the part of the charging hose 44 positioned on the drum 28. Through the recess 48 the charging hose 44 thereafter passes into the central shaft 38 to be discharged at the one end of this latter. At the central shaft end in consideration a coupling together of the charging tube 44 rotating with the drum 28 and a stationary tube conduit 58 drawn from an explosive source 52, 54 or 56, respectively, is accomplished by employing a rotatable coupling in the form of a swivel 60. A hydraulic motor 62 is devised to impart rotation to the drum 28 relative the drum cage 30 by utilizing a driving chain 64 which passes about two sprockets 66, 68. The hydraulic motor 62 is mounted directly on the drum cage 30 at one side thereof.

The drum cage 30 enclosing the drum 28 is in turn mounted separately turnable on the central shaft 38 of the drum 28 and constitutes a supporting structure for a ring of cylindrical idle driving rollers 70 which with a spacing adapted to the hose surround the hose track of the drum 28 and have for their object to prevent movement of the hose in the radial direction of the drum 28. This is specially important during advance feed of the charging hose 44.

A telescopically operated extension unit 72 is rigidly attached to the top portion of the drum cage 30, and this extension unit can be elevated by having the drum cage 30 pivoted about the central shaft 38 relatively to the cradle 32. For this purpose a hydraulic cylinder 74 is used, which cylinder is mounted on the base plate 76 of the cradle 32, the end of a piston rod 78 cooperating with the cylinder being pivotably connected with a pin 80 on the outer frame 82 of the drum cage 30.

The base plate 76 of the cradle 32 is provided with two uprights 84 supporting the drum shaft 38 disposed on either side of the drum cage 30. The base plate 76 rests on a turntable 86 against the platform and can be rotated by slightly less than one revolution relative a footbase 88 by means of a hydraulic motor 90. The hydraulic motor 90 is over a pinion 92 is engagement with an inner gear ring 94 of the turntable 86 below the base plate 76 which latter supports an oil tank 96 with the airoperated hydraulic pump 16 and an interior control pulpit 97. The oil tank 96 with superposed air-operated pump motor 16 and the control pulpit 97 are built together to constitute a single unit for internal operation and control of all functions relating to the handling of the charging hose 44, 58. The control pulpit 97 by being positioned on the front side of the base plate is accessible for an operator standing on the ground behind the truck platform, provided that the hose feeding winch 10 initially has been turned from the transport position into the working position for feeding, wherein the front end of the extension unit 72 is directed towards the rear portion of the truck.

The telescopically operated extension unit 72 comprises the telescopic unit proper and a nose device 98 terminating the front of the former and intended for fine adjustment in relation to the drill-hole. The telescopic unit is composed of profiled parts 100, 102 running in each other, the one movable part 102 being longitudinally displaceable within the other stationary profiled part 100. To render possible the displacement a hydraulic cylinder 104 in a manner known per se is arranged to act between the profiled parts in the telescopic unit. Running inside the inner profiled part 102 are carriers 106 for runner rings 108 guiding the charging hose 44. Each carrier 106 is equipped with two rollers 110 one on either side of the carrier 106, said rollers 110 being in contact with the inner profiled part 102 on either side of a longitudinally extending groove 112 formed in the same. A corresponding groove 114 is also formed at the front end of the outer profiled part 100, and the carriers 106 project downwards between the rollers through the aligned grooves 112, 114. The circular apertures 116 through which the charging hose 44 runs are positioned excentrically in the runner rings which are fixed to the carriers 106 adjacent the ring sides formed of the thickest material. The carriers are coupled in relation to one another and to the extension unit 72 in such a manner by means of torsion link elements 118 that they always are distributed uniformly in relation to one another irrespective of the position of the profiled parts 100, 102 relative one another.

A guide tube 120 is provided for guiding the charging hose 44 from the jacket 42 of the drum 28 to the runner rings 108 and in opposite direction. In this connection one end 122 of the guide tube 120 by means of a rotary coupling 124 is pivotally attached to the stationary profiled part 100 of the extension unit 72 immediately adjacent the runner ring 108 located nearest to the drum 28. The other end 126 of the guide tube 120 which is directed towards the drum 28 is freely movable in lateral direction over the breadth of the drum depending on th outfed position of the charging hose 44 relative the drum 28, and as at 127 is arranged pivotably in relation to the first end 122 in such a manner that it always is displaced laterally in parallel relation with the extension unit 72. Hereby the feeding of the charging hose 44 into the guide tube 120 is facilitated. Provided between said other end 126 and the stationary profiled part 100 of the extension unit 72 is a boundary member 128 which prevents the guide tube end 126 from being lifted up relatively to the hose track. Suitably, the guide tube 120 rests against the jacket 42 of the drum 28 via one of the driving rollers 70 of the drum cage 30. The outer part of the telescopically operated extension unit 72 comprises, as mentioned, the nose device 98 which is pivotable both laterally and upwardly with respect to the extension unit 72. The nose device 98 comprises principally two pivot plates 130 and 132 located adjacent one another and united with one another at the upper short side by a hinge 134. Through the hose holes 136, 138 in the two pivot plates the charging hose 44 can run freely. When the pivot plates are in a position parallel adjacent one another, the holes 136, 138 are positioned straight opposite each other. The inner pivot plate 132 is rotatably attached to the outer end of the movable profiled part 102 and the corresponding hose hole 136 is located in the centre of rotation. In this connection a little hydraulic cylinder 140 is disposed between the said outer end of the movable profiled part 102 and the inner pivot plate 132 to render possible rotary movement in lateral direction of the nose device via a hub element 142 making the movement possible. A separate holding member 141 is used for fastening the hydraulic cylinder 140 onto the movable profiled part 102. The outer pivot plate 130 which straight opposite the hose hole 138 carries an upwards bent guide rail of U-profile type, is forced outwards at the lower edge by means of a hydraulic cylinder 146 mounted between the inner and the outer pivot tables 132 and 130, respectively. This is illustrated most clearly in FIG. 2, where the swung-out position is indicated by dash-and-dotted lines. The guide rail 144 for the charging hose 44 is equipped with interior rolls 148 both on the upper side and on the lower side of the charging hose 44 which results in that the charging hose 44 runs easily in the guide rail 144. Disposed at the outer end of the guide rail 144 is a short guide bushing 150 with a stop flange 152. The guide bushing 150 is intended to be introduced into a drill-hole 154 in such a manner that the stop flange 152 will make contact around the mouth of the drill-hole.

On the fore part of the truck platform three receptacles 52, 54, 56 are mounted in hollow stands 153 in such a manner that the outlet of the receptacles projects downwards through openings in the platform. Sluice valves intended for control of the feeding of the explosives and hose connections (not shown) will thus be positioned below the platform.

The two major receptacles 52, 54 may in the shown embodiment be intended for powder explosives of different strength for column charging and the minor container 56 for powder for bottom charging. Each receptacle is connected by means of a branch pipe connected to the common hose pipe 58 which from the underside of the platform passes upwards through a central hole 156 in the turntable 86 of the cradle 32 and thereafter in a suitable manner in a soft coil via one side of the drum cage 30 extends to the rotatable coupling 60 at the one end of the central shaft 38.

All air-operation of the explosive receptacles 52, 54, 56 is effected centrally from a control pulpit 158 which is arranged stationary at the right-hand side of the rear edge of the platform. As stated already, the operator's position normally is located to a place adjacent the rear edge of the platform where the operator standing on the ground always has the stationary control pulpit 158 within his easy reach. From the control pulpit 97 thus the internal oil distribution system of the car is controlled and the local air duct of the working place should normally be put in for operation of the internal hydraulic system when the truck has arrived at its working place and its support legs have been pushed down. Therewith control members for the following operational functions are available on the stationary control pulpit 158:

1. Initial starting by pivoting the hose feeding cradle 32 180° rearwardly to its working position by admission of compressed air to the internal hydraulic system of the cradle. Thereby the internal control pulpit 97 becomes exposed and therewith also the operative members for the working cycle groups 1 – 7 below.

2. Powder blowing for bottom charging.

3. Powder blowing for column charging of certain kind.

4. Powder blowing for column charging of another kind.

5. Repivoting of the cradle during the final phase into its forward position.

Governed from the internal control pulpit 97 are:

1. The pivotal positions of the cradle 32.

2. The elevation of the extension unit 72.

3. The degree of projection of the extension unit 72.

4. The lateral declination of the nose device 98.

5. The declination in forward or backward direction of the nose device 98.

6. The advance feed or retraction of the charging hose 44 (rotation of the drum 28).

7. The re-pivoting of the cradle 32 during the starting phase. In this connection the appropriate operating lever is set to "left-hand" and when the cradle has pivoted into the forward position the movement is interrupted by the supply of air being stopped at the control pulpit 158. By thereafter switching over the operating lever to "right-hand" the cradle is prepared for reversal when a new cycle is to be started.

An igniter 161 equipped with an ignition wire 160 is introduced in conventional manner into the mounth of the charging hose 44. This is effected suitably when the mouth end of the hose just projects out from the guide tube 120 and is on its way into the annular track cooperating with the movable profiled part 102. In this way the ignition wire 160 will during the advance feeding of the charging hose 44 be drawn along through the runner rings 108 and out through the guide rail 144. Upon finished charging and lowering of the extension unit 72 for access into a new drill-hole the remaining final end of the ignition wire 160 is retracted out from the guide rail 144 and the annular track either by means of a traditional hook bar or by manual action so that the ignition wire 160 will freely hang down outside the drill hole 154 in customary manner.

In the drawing FIG. 1 there is also shown on the truck platform a store box 162 for storage of detonating caps and a store box 164 for tools.

It should be obvious that a plurality of various modifications of the hose feeding winch 10 described above are possible to be carried out within the scope of the invention. Instead of the sheet iron 40 placed on edge which bounds the track for the charging hose in lateral direction it is possible to use separately adjustable (coupling) guide pieces which are fastened by screwing across the external jacket of the drum 28 for confining the charging hose track in lateral direction. By change of the positions relative one another of guide pieces it becomes possible to bring about an adaption to charging hoses of various dimensions and desired winding of the hose along the drum jacket.

In working places where a permanent requirement exists for great reach of the extension unit an additional extension can be attained by placing an extension pipe at the pivot centre of the inner pivot plate 132. This requires, of course, a corresponding extension of the hydraulic hoses to the cylinder 146 of the outer plate.

Having thus described my invention, what I claim is:

1. A hose feeding winch especially intended for use in connection with charging of drill holes to take up and advance a charging hose for powder explosives or pumpable explosives, comprising a central shaft, a cradle rotatably supporting said central shaft, a drum rotatable on said central shaft, means defining a spiral groove on the outer peripheral surface of said drum for guiding a charging hose to be wound up in a single layer on the periphery of said drum, when the latter is rotated in one direction, a drum cage surrounding said drum and mounted for rotation on said central shaft independently of said drum, and a plurality of cage elements disposed around the drum in cooperative relation with the groove defining means on said drum in order to limit movement of the wound hose in the radial direction of the drum.

2. A winch according to claim 1 wherein said cage elements comprise a plurality of cylindrical idler rollers rotatably mounted in said cage and arranged in a circular path around the outside of said drum.

3. A winch according to claim 1, wherein said central shaft comprises a tube mounted rigidly relatively to said drum, two uprights project vertically from a rotatable base plate on said cradle, and bearings at each side of said drum support the latter for rotation on said uprights.

4. A winch according to claim 3, including a first hydraulic device mounted adjacent said drum cage and cradle and operatively connected to said drum to control the rotation of said drum selectively to wind said hose onto and off of the drum.

5. A winch according to claim 4, including a second hydraulic device interposed between said drum cage and said base plate of the cradle and operable to pivot said drum cage about the axis of said central shaft independently of said drum.

6. A winch according to claim 5, wherein said base plate of the cradle is rotatably mounted on a turntable.

7. A winch according to claim 6, wherein a third hydraulic device is connected to, and is arranged for accomplishing the rotation of, said base plate.

8. A winch according to claim 4, including means for feeding said charging hose with explosives, comprising a pipe connected at one end to a source of explosives, and extending into one end of the central shaft, and means connecting the opposite end of said pipe to said charging hose to supply said explosives thereto.

9. A winch according to claim 8, wherein the last-named means comprises a rotatable coupling disposed at said one end of said central shaft for coupling together the charging hose, which is rotatable with the drum, and said pipe, which is stationary.

10. A winch according to claim 1, wherein said guiding means comprises a spiral member fixed on the periphery of said drum and disposed so that during advance the hose, upon rotation of said drum, sufficient friction is obtained between said member and the charging hose to prevent the latter from creeping by slipping on said drum.

11. A winch according to claim 1, including a telescopically operated extension unit fixed to the top portion of said drum cage and means for guiding the hose for advancement along said unit, including a plurality of hose guiding members mounted for movement along the underside of the extension unit, and an adjustable nose unit mounted on the outer end of the extension unit and intended for use in the alignment of the hose with a drill hole that is to be charged.

12. A winch according to claim 11, wherein the nose unit is mounted to be swingable both laterally and upwardly and downwardly with respect to the guiding members on said extension unit.

13. A winch according to claim 12, wherein separate hydraulic devices are connected to said nose unit for swinging the nose unit selectively in lateral directions, and upwardly and downwardly, respectively.

14. A winch according to claim 11, wherein said hose guiding members include a plurality of hose-carrying runner rings carried by supports mounted on rollers which roll in a movable, profiled part of said extension unit, and a plurality of torsion links are pivotally connected to each other and to said supports in such a manner that said supports are always spaced uniformly irrespective of the length of said extension unit.

15. A winch according to claim 14, including a guiding tube registering with said rings and positioned between said rings and the periphery of said drum to guide said hose from the drum to said runner rings, said guiding tube being rotatably attached to a stationary profiled part of said extension unit adjacent the runner ring situated nearest to said drum, and the other end of said guide tube, which is adjacent the drum, being movable freely in lateral directions over the breadth of the drum depending on the feed position of the charging hose relative to the drum.

16. A winch according to claim 15, wherein said guiding tube comprises two parts pivotally connected with one another, the part facing the drum being arranged so as always to be displaced laterally in parallel relation with said extension unit.

17. A winch according to claim 16, including a control pulpit disposed on said base plate of the cradle and having manually operable members thereon for governing, selectively, the rotary position of the cradle, the elevation of the extension unit, the length of the extension unit, the lateral deflection of the nose unit, and the deflection upwardly and downwardly of the nose unit, as well as the advance and retraction of the charging hose.

* * * * *